US005826817A

United States Patent [19]

Selby

[11] Patent Number: 5,826,817

[45] Date of Patent: Oct. 27, 1998

[54] SELF DISPENSING AND STORAGE DEVICE FOR FLEXIBLE TUBING

[76] Inventor: William J. Selby, 1530 West Dr., Stoughton, Mass. 02072

[21] Appl. No.: 876,631

[22] Filed: Jun. 16, 1997

[51] Int. Cl.[6] ..... B65D 83/00; B65H 55/00

[52] U.S. Cl. ..... 242/588.6; 242/129; 206/395; 206/409

[58] Field of Search ..... 242/588.6, 588.3, 242/598.5, 598.6; 206/395, 409

[56] References Cited

U.S. PATENT DOCUMENTS

| | | | |
|---|---|---|---|
| 1,826,084 | 10/1931 | Mohr | 242/137.1 |
| 3,184,053 | 5/1965 | Eldridge | 242/588.6 |
| 3,390,844 | 7/1968 | Dillow et al. | 242/129 |
| 3,680,810 | 8/1972 | Jarmalow | 242/171 |
| 3,693,784 | 9/1972 | Holmes | 206/409 |
| 3,982,712 | 9/1976 | Bassett | 242/129 |
| 4,006,854 | 2/1977 | Gibson et al. | 206/409 |
| 4,844,373 | 7/1989 | Fike, Sr. | 242/588.1 |
| 5,494,160 | 2/1996 | Gelmetti | 206/395 |
| 5,704,479 | 1/1998 | Barnett et al. | 206/395 |

*Primary Examiner*—John P. Darling

[57] ABSTRACT

The present invention is a device for storing and dispensing flexible tubing. In one embodiment, the device comprises a first side wall, a second side wall, a rear end wall, and a front end wall having a slot formed therein. The device further comprises a spool member moveably engaged with the first and second side walls. The device further comprises a flexible tubular member having first and second end portions and a median portion. In operation, the median portion of the flexible tubular member is wrapped about the spool member and the first end portion of the flexible tubular member is dispensed through the slot of the front end wall. The device may further comprise a cover removably disposed about the first and second side walls, the front end wall and the rear end wall.

6 Claims, 3 Drawing Sheets

SELF DISPENSING AND STORAGE DEVICE FOR FLEXIBLE TUBING

BACKGROUND OF THE INVENTION

The present invention relates generally to the field of dispensing and storage devices. More particularly, the present invention relates to the field of dispensing and storage devices for flexible tubing.

SUMMARY OF THE INVENTION

Disclosed is a device for storing and dispensing flexible tubing. In one embodiment, the device comprises a first side wall, a second side wall, a rear end wall, and a front end wall having a slot formed therein. The device further comprises a spool member moveably engaged with the first and second side walls. The device further comprises a flexible tubular member having first and second end portions and a median portion. In operation, the median portion of the flexible tubular member is wrapped about the spool member and the first end portion of the flexible tubular member is dispensed through the slot of the front end wall. The device may further comprise a cover removably disposed about the first and second side walls, the front end wall and the rear end wall.

BRIEF DESCRIPTION OF THE DRAWINGS

The following detailed description of the invention will be more fully understood with reference to the accompanying drawings in which.

DETAILED DESCRIPTION OF THE PREFERRED EMBODIMENTS

Figure 1:
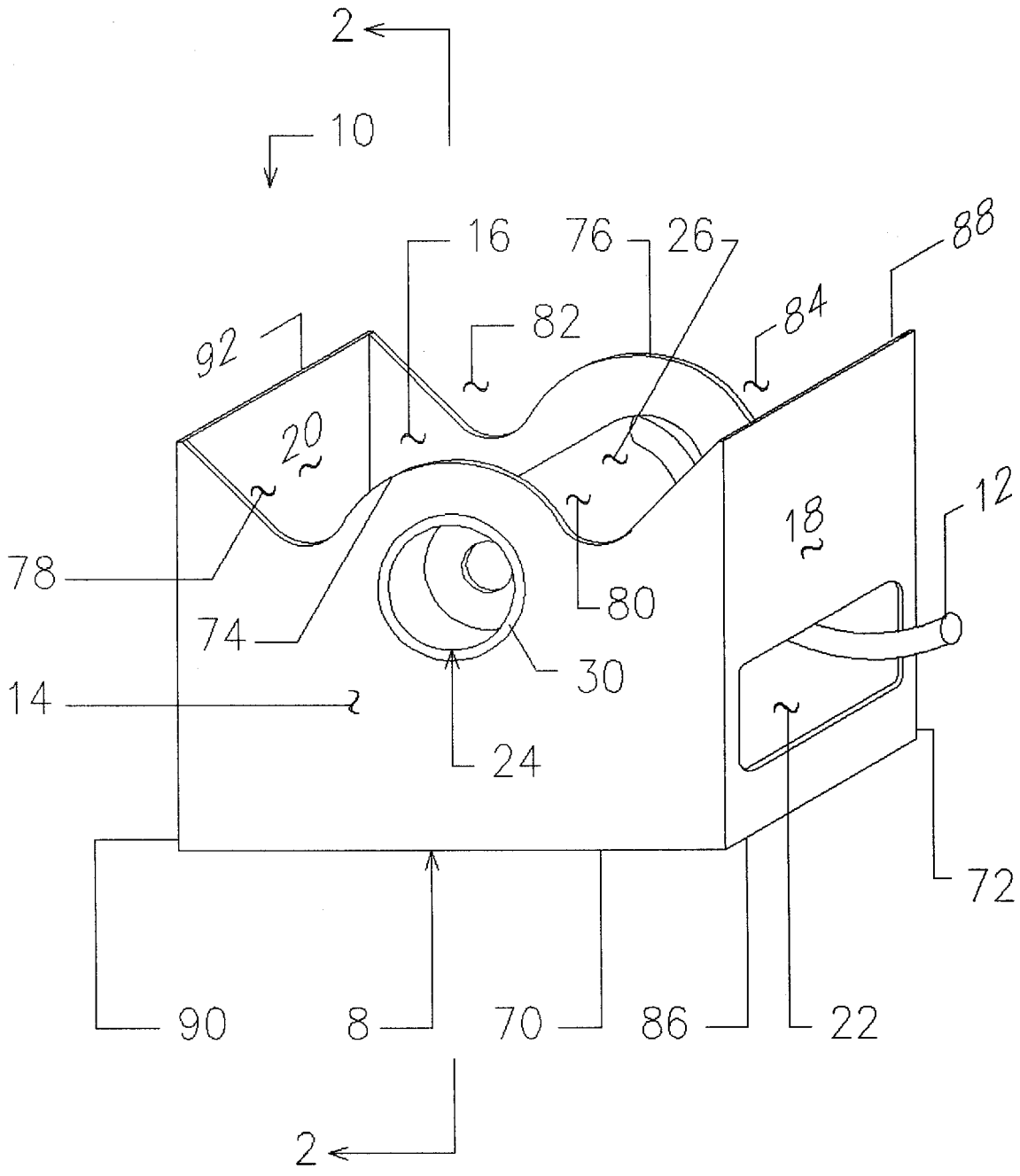
FIG. 1 is a perspective view of the device of the present invention.
Figure 2:
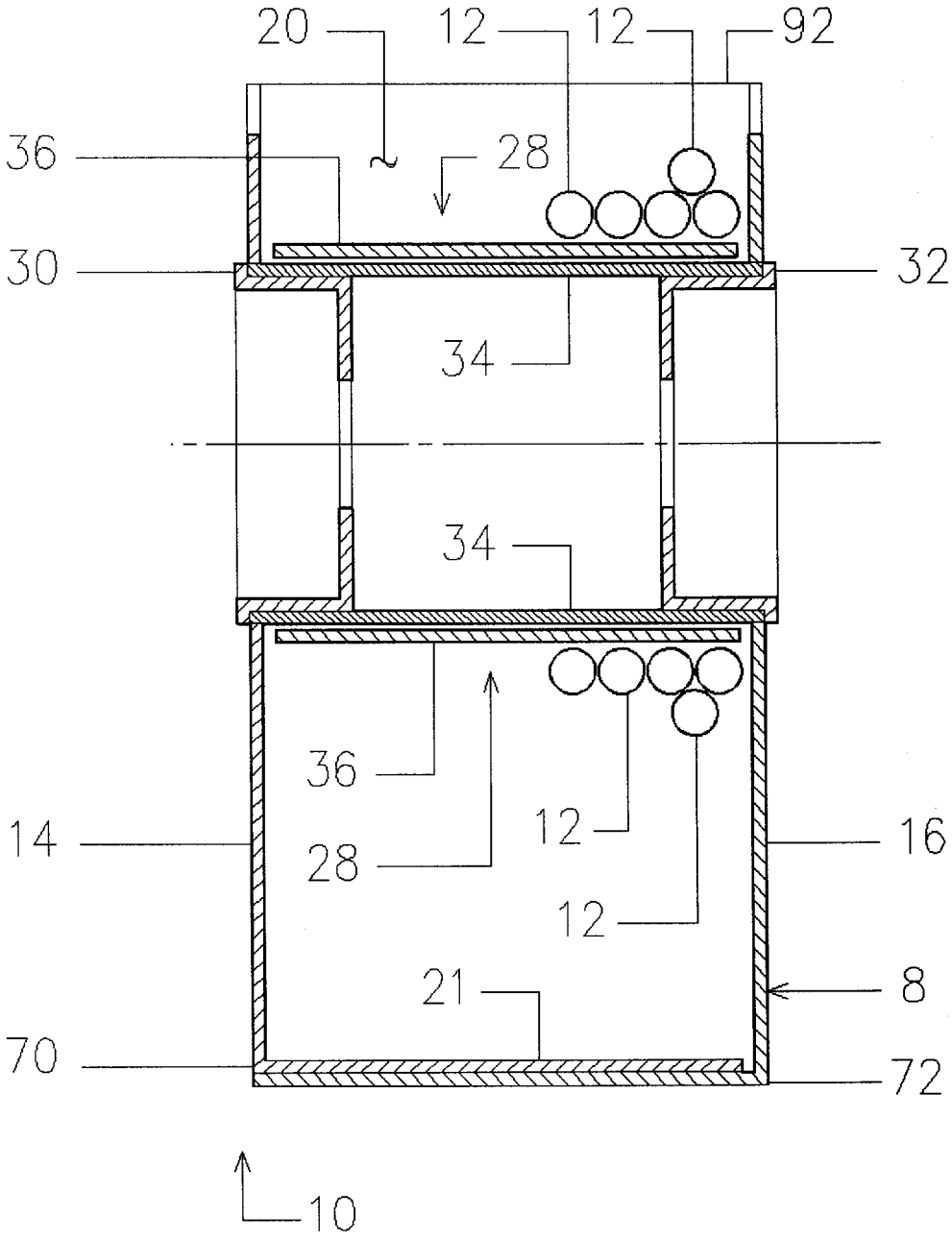
FIG. 2 is a cross-section view taken along line 2—2- of FIG. 1.

Referring to FIGS. 1 and 2 wherein the device 10 of the present invention is shown having a flexible tubing 12 ready for dispensing. The device 10 generally comprises a rectangular shaped box 8 having side walls 14 and 16, a front end wall 18, a rear end wall 20, and a bottom wall 21. Disposed in the front end wall 20 is a rectangular slot 22 which is adapted to allow the flexible tubing 12 to be passed and dispensed therethrough as needed. Sidewall 14 comprises a bottom edge 70 and a top edge 74 and recess areas 78 and 80 extending from the top edge 74. Sidewall 16 comprises a bottom edge 72 and a top edge 76 and recess areas 82 and 84 extending from the top edge 76. The front end wall 18 comprises a bottom edge 86 and a top edge 88. The rear end wall 20 comprises a bottom edge 90 and a top edge 92. The top edges 88 and 92 of the front end wall 18 and rear end wall 20, respectively, are higher than the recess areas 78 and 80, and 82 and 84 of the sidewalls 14 and 16, respectively.

The device 10 further comprises a spool assembly 28 securely supported and engaged by openings 24 and 26 disposed in side walls 14 and 16, respectively. Spool assembly 28 generally comprises end flanges 30 and 32, a cylindrical core 34, and a spool 36 movably disposed about the cylindrical core 34. End flanges 30 and 32 are adapted to snugly pass through openings 24 and 26 and securely engage and fix from rotation the cylindrical core 34. The ability of the spool 36 to rotate about the cylindrical core 34 allows the flexible tubing 12 (which is rolled about the spool 38) to be easily dispensed by simply pulling on the free end of the flexible tubing 12.

Figure 3:
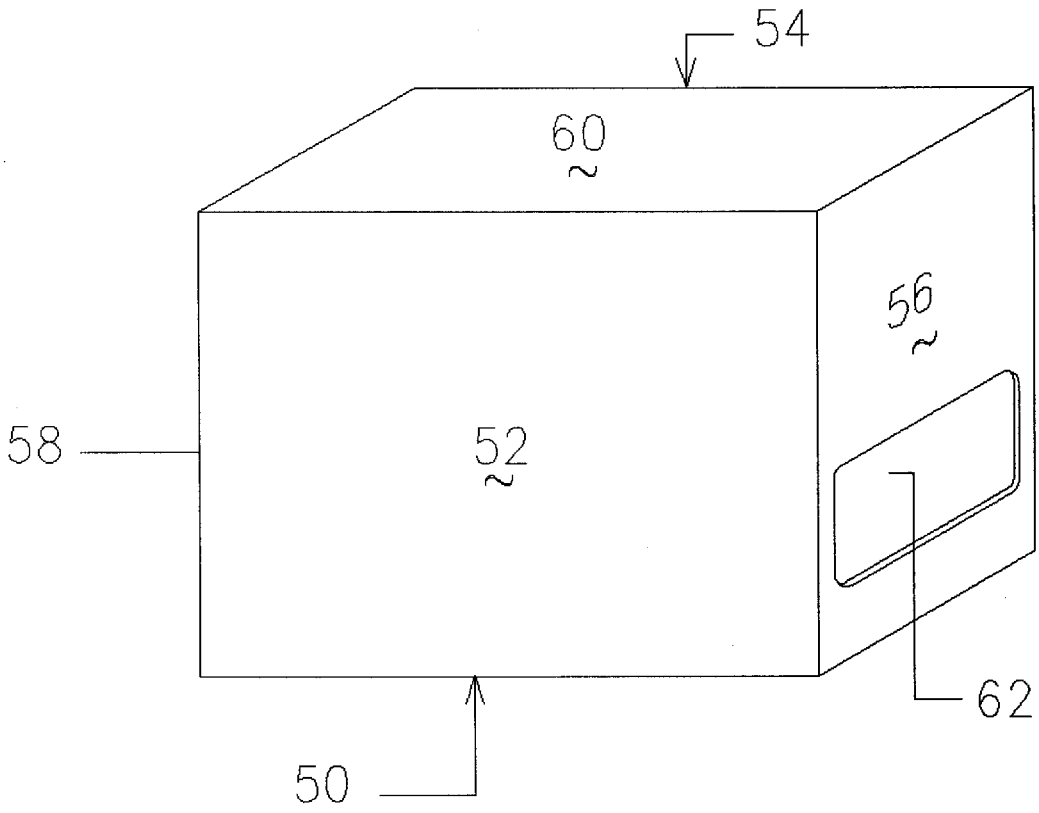
FIG. 3 is a perspective view of the cover.

As shown in FIG. 3, the device 10 may further comprise a cover 50 which is adapted to fit snugly over the rectangular shaped box 8. The cover 50 is useful when storing the device 10. In one embodiment, the cover 50 comprises first and second side walls 52 and 54, a front end wall 56, a rear end wall 58, and a top wall 60. The cover 50 may further comprise a slot 62 disposed in the front end wall 56 which is aligned with slot 22 when the cover 50 is placed over the box 8.

The device may be made from a variety of materials. The various components of device 10 as described above may be formed from a variety of separate pieces joined together by conventional fastener means such as adhesive. Preferably, however, the box 8 is formed from a single piece of corrugated cardboard which is formed into the assembled configuration by conventional automated bending operations.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed:

1. A device for storing and dispensing flexible tubing comprising:

(a) a first side wall comprising a bottom edge and a top edge, said first side wall further comprising a first recess area extending from said top edge;

(b) a second side wall comprising a bottom edge and a top edge, said second side wall further comprising a first recess area extending from said top edge;

(c) a front end wall comprising a slot formed therein, said front end wall comprising a bottom edge and a top edge, said top edge of said front wall being higher than said first recess area of said first side wall and said first recess area of said second side wall;

(d) a rear end wall, said rear wall comprising a bottom edge and a top edge, said top edge of said rear end wall being higher than said first recess area of said first side wall and said first recess area of said second side wall;

(e) a spool assembly engaged with said first and second side walls;

(f) a flexible tubular member having first and second end portions and a median portion, said median portion of said flexible tubular member being wrapped about said spool member and said first end portion of said flexible tubular member being passed through said slot of said front end wall; and (g) a cover removably disposed about said first and second side walls, said front end wall and said rear end wall.

2. The device of claim 1, wherein said spool assembly comprising first and second end flanges engaged with said first and second side walls, respectfully, said spool assembly further comprising a cylindrical core engaged with said first and second end flanges, said spool assembly further comprising a spool member moveably engaged with said cylindrical core.

3. The device of claim 1, wherein said first side wall comprises a second recess area extending from said top edge of said first side wall and said second side wall comprises a second recess area extending from said top edge of said second side wall.

4. The device of claim 3, wherein said top edge of said front end wall being higher than said second recess area of said first side wall and said second recess area of said second side wall.

5. The device of claim 4, wherein said top edge of said rear end wall being higher than said second recess area of said first side wall and said second recess area of said second side wall.

6. The device of claim 1, wherein said cover comprises a slot aligned with said slot of said front end wall when said cover is disposed about said first and second side walls, said front end wall and said rear end wall.

* * * * *